United States Patent [19]

Tobinaga et al.

[11] Patent Number: 4,459,951

[45] Date of Patent: Jul. 17, 1984

[54] OVERHEAT PREVENTING SYSTEM FOR INTERNAL COMBUSTION ENGINES

[75] Inventors: Motoi Tobinaga, Hamamatsu; Yutaka Nasuda, Shizuoka, both of Japan

[73] Assignees: Yamaka Hatsudoki Kabushiki Kaisha, Iwata; Sanshin Kogyo Kabushiki Kaisita, Hamamatsu, both of Japan

[21] Appl. No.: 389,897

[22] Filed: Jun. 18, 1982

[30] Foreign Application Priority Data

Jun. 29, 1981 [JP] Japan ..... 56-102058

[51] Int. Cl.[3] ..... F02B 77/08

[52] U.S. Cl. ..... 123/198 DC; 123/41.15; 123/335

[58] Field of Search ..... 123/198 D, 198 DC, 334, 123/335, 41.15

[56] References Cited

U.S. PATENT DOCUMENTS

| | | | |
|---|---|---|---|
| 3,385,278 | 5/1968 | Johnson et al. | 123/41.15 |
| 3,776,204 | 12/1973 | Harris | 123/335 |
| 4,023,549 | 5/1977 | Hewitt | 123/198 D |
| 4,171,687 | 10/1979 | Coventry | 123/335 |
| 4,204,490 | 5/1980 | Ohki et al. | 123/335 |
| 4,218,998 | 8/1980 | Hill et al. | 123/335 |
| 4,344,395 | 8/1982 | Kondo et al. | 123/335 |

*Primary Examiner*—Ira S. Lazarus

*Attorney, Agent, or Firm*—Donald D. Mon; David O'Reilly

[57] ABSTRACT

A system for preventing overheating of an internal combustion engine comprised of a temperature detector which activates an electronic circuit to intermittently interrupt engine ignition spark to gradually decelerate the engine. The electronic circuit has an oscillator which is activated by the temperature detector whose duty cycle is gradually increased up to a maximum. The oscillator output energizes a gating circuit to turn on a thyristor which connects an ignition charging circuit to ground. Thus interrupting the ignition spark.

7 Claims, 2 Drawing Figures

OVERHEAT PREVENTING SYSTEM FOR INTERNAL COMBUSTION ENGINES

FIELD OF THE INVENTION

The present invention relates to an overheat preventing system for reducing the r.p.m. of an internal combustion engine from an overheated state thereby to prevent the engine from being damaged.

BACKGROUND OF THE INVENTION

If an internal combustion engine is run at an overheated state, problems such as piston seizure may take place and damage the engine. Especially in an engine continuously running at a constant speed, such as a boat engine, the driver may sometimes fail to instantly take the proper measures for that trouble during high speed running operation. With this in mind, the concept of reducing the r.p.m. by interrupting the ignition spark of one or more of the engine cylinders when it is detected that the engine is overheated has been proposed by the same Applicant (e.g., Japanese Patent Application No. 55-83732). In this proposal, however, the r.p.m. may be abruptly reduced in accordance with the kind of engine; such as an engine having fewer cylinders thereby causing shocks in the navigation of the boat.

BRIEF DESCRIPTION OF THE INVENTION

The present invention has been conceived in view of the background thus far described and has as an object the provision of an overheat preventing system for an internal combustion engine, which is able to detect overheating of an engine and smoothly reduce the r.p.m. of the engine so that damage to the engine may be prevented due to the overheating, and deceleration will be less of a shock.

In order to achieve the above-specified object, the present invention is constructed to include a temperature detector for detecting overheating of a spark ignition type internal combustion engine, and an oscillation circuit for oscillating in accordance with the output of said temperature detector so that said internal combustion engine is decelerated from its overheated state by having its ignition intermittently stopped in accordance with the output of said oscillation circuit. The present invention will be described in greater detail in the following description considered in connection with the embodiment thereof shown by reference to the accompanying drawings.

DETAILED DESCRIPTION OF THE INVENTION

Figure 1:
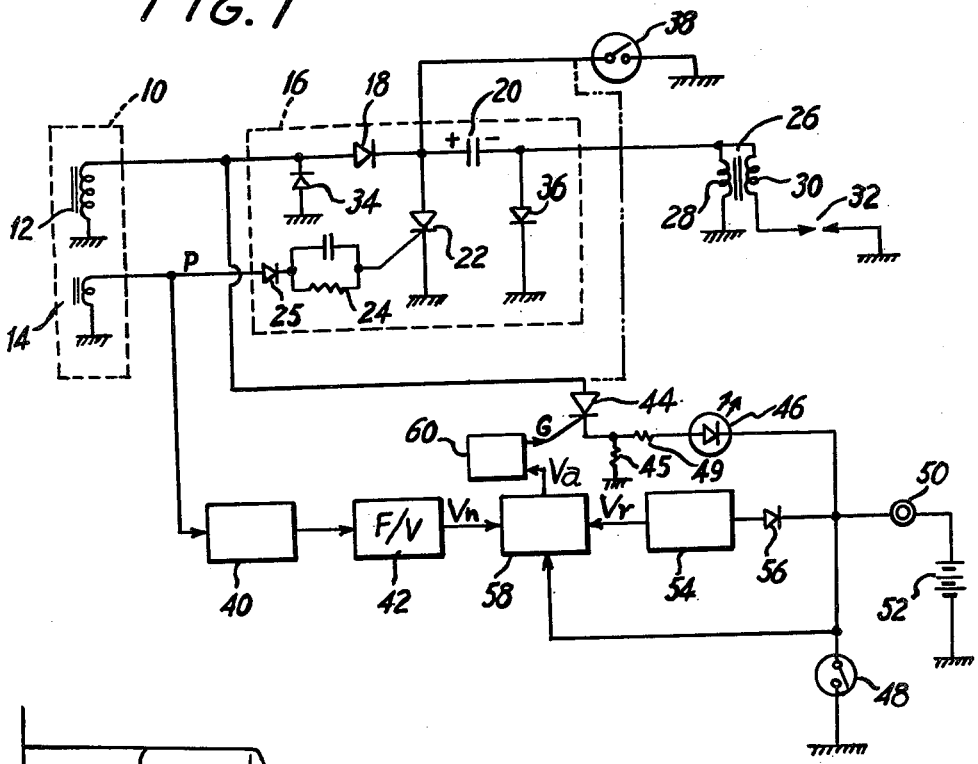
FIG. 1 is a circuit diagram showing the construction of the one embodiment of the present invention.
Figure 2:
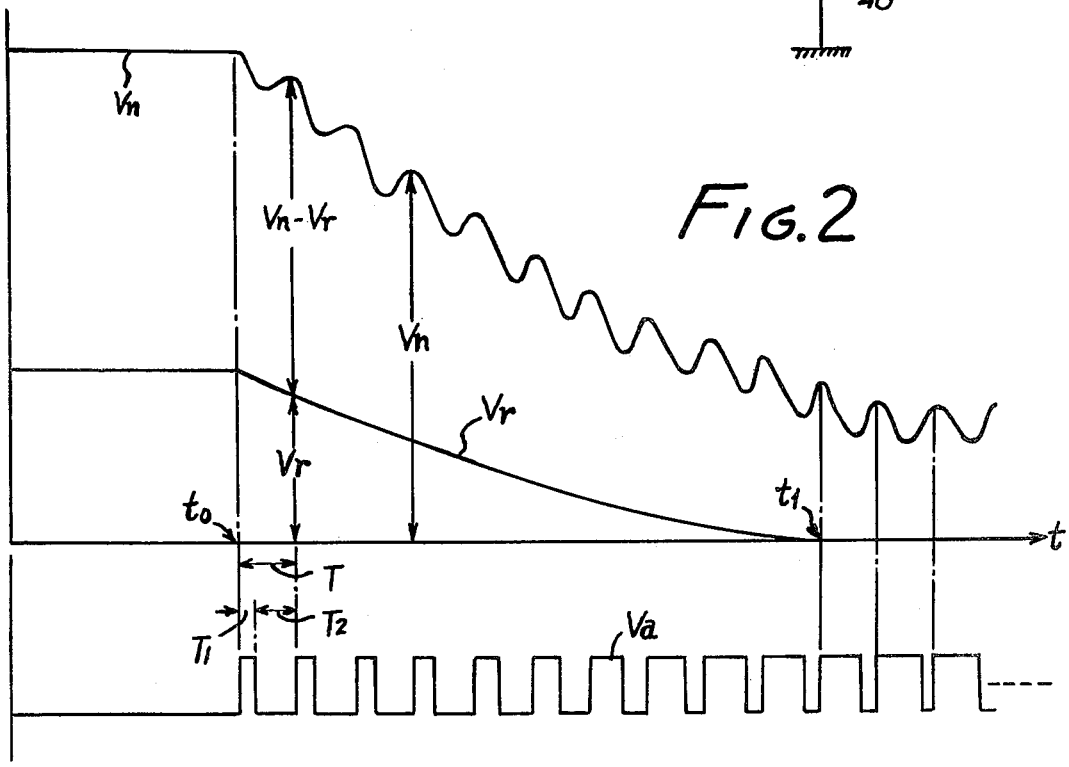
FIG. 2 is a diagram illustrating the operations of the device same of FIG. 1.

FIG. 1 is a circuit diagram showing the construction of one embodiment of the present invention; and FIG. 2 is a diagram illustrating the operation of the same. Reference numeral 10 appearing in FIG. 1 indicates a magneto which is equipped with a charging coil 12 and a pulser coil 14. Pulser coil 14 operates to generate a pulser signal P at a predetermined angular position of the crankshaft of the engine. Numeral 16 indicates a well-known capacitive discharge type ignition circuit which is composed of: a series diode 18 allowing the positive half wave of an a.c. output generated by charging coil 12 to pass therethrough; a series capacitor 20 charged to a shown polarity by the current passing through diode 18; a thyristor 22 for discharging the charge stored in capacitor 20 through primary coil 28 of a later-described ignition coil 26; a CR (capacitor-resistor) differentiation circuit 24 and a diode 25 connected to the gate of thyristor 22. Numeral 26 indicates the ignition coil having one side of primary coil 28 and a secondary coil 30 connected to the aforementioned capacitor 20. The other terminal of the primary coil 28 is connected to earth grounded. Moreover, the other terminal of secondary coil 30 is connected to ground through ignition plug 32.

When the a.c. voltage generated by charging coil 12 is the negative half of wave, the electric current is fed to coil 12 by diode 34. For the positive half of the wave in contrast, the current fed from coil 12 passes through diode 18 to charge capacitor 20 at the shown polarity. The pulser signal P from the aforementioned pulser coil 14 is differentiated by CR differentiation circuit 24 to ignite thyristor 22. In other words, thyristor 22 is closed by the rise of the waveform of pulser signal P. As a result, charges on capacitor 20 are released through thyristor 22 and primary coil 28 so that a high voltage is induced in secondary coil 30 by the change in magnetic flux in ignition coil 26 at that time. By the voltage induced at the secondary coil 30, the ignition plug 32 generates an ignition spark. Capacitor 20 is charged to a polarity opposite to that of FIG. 1 when it is discharging through thyristor 22 and primary coil 28. However, this opposite charge will be released through parallel diode 36.

Reference numeral 38 indicates a stop switch which has one terminal connected between the aforementioned series diode 18 and capacitor 20 and its other terminal connected to ground. Stop switch 38 as connected is usually open but is closed when the engine is to be stopped. More specifically by closing stop switch 38, the charging operation of capacitor 20 is interrupted, whereupon the ignition plug 32 generates no spark and the engine is stopped.

The overheat preventing system according to the present invention will be described with reference to the following. Reference numeral 40 indicates a waveform shaping circuit for converting the aforementioned pulser signal P into pulses having a square wave shape. Numeral 42 indicates a frequency-voltage converting circuit (hereinafter referred to as an "F/V converting circuit") for converting the output pulse frequency of waveform shaping circuit 40 into a voltage. Therefore, F/V converting circuit 42 generates a velocity voltage $V_{n'}$ (i.e., a voltage indicating a velocity which is increased or decreased in accordance with the increase or decrease of engine r.p.m.). Numerals 44, 45, 46 and 48 indicate a thyristor, a grounding resistor connected to thyristor 44, a light emitting diode, and a temperature detector, respectively. Temperature detector 48 is constructed of, for example, a switch having bimetal contacts and is attached in the vicinity of a hot portion of the engine. Moreover, temperature detector 48 thus constructed will be closed when the engine overheats. With the cathode of the aforementioned thyristor 44, are connected in series with resistor 49, a light emitting diode 46 and a temperature detector 48 having its other terminal connected to ground. Thyristor 44 and light emitting diode 46 are connected so that their polarity allows electric current on the positive half wave of the output from charging coil 12 to pass therethrough. Numerals 50 and 52 indicate an audible warning buzzer and a battery, respectively, in a series connected circuit which is connected in parallel with the aforementioned temperature detector 48.

Reference numeral 54 indicates a delay circuit having an input terminal connected through diode 56 to the nongrounded of the aforementioned temperature detector 48. Delay circuit 54 has an integrating capacitor, for example, so that its output voltage $V_r$ becomes a predetermined integrated voltage during normal operation of the engine which is gradually lowered (i.e. decays) by discharges the integrating capacitor when the temperature detector 48 closes due to overheating of the engine.

Reference numeral 58 indicates an oscillation circuit activated to its oscillations when the temperature detector 48 closes. Oscillation circuit 58 generates an oscillatory output $V_a$ which has its duty ratio DR (i.e. duty cycle) varied in accordance with the difference $(V_n-V_r)$ between the velocity voltage $V_n$ from the output of F/V converting circuit 42 and the output voltage $V_r$ of delay circuit 54. As illustrated in FIG. 2, specifically, the oscillatory output $V_a$ has a small duty ratio of $DR=T_1/T_1+T_2$ when the difference $(V_n-V_r)$ is large immediately after time to when the temperature detector 48 closes. The duty ratio DR increases gradually in accordance with a reduction in the difference $(V_n-V_r)$ as time subsequently elapses. The oscillation period $T=T_1+T_2$ of oscillation circuit 58 is set to be of sufficient length to be longer than the time period required for one revolution of the engine. In other words, the engine revolves a plurality of times during time period T. Numeral 60 indicates a gate circuit which when energized generates a gate signal G synchronized with the revolutions of the engine during the time period $T_1$ when the output $V_a$ of the aforementioned oscillation circuit 58 is at a high level. In other words, that gate signal G generated closes the thyristor 44 when the output voltage of the aforementioned charging coil 12 has a predetermined positive level. During the time period $T_1$, consequently, the current resulting during the positive half wave of the charging coil 12 is discharged through thyristor 44, light emitting diode 46 and temperature detector 48 to ground so that no spark is generated at ignition plug 32.

The operation of the embodiment thus constructed will be described in the following. When the engine is run at full load but without being overheated, temperature detector 48 remains so that oscillation circuit 58 does not oscillate. As a result, gate circuit 60 does not generate a gate signal G. Thus, capacitor 20 is charged by the positive half wave of charging coil 12 so that an ignition spark is normally generated at ignition plug 32 whereby the engine continues its normal revolutions.

When the engine becomes overheated, temperature detector 48 closes so that the oscillation circuit 58 is activated and starts oscillating. Since the aforementioned difference $(V_n-V_r)$ is large immediately after time $t_0$, when temperature detector 48 first detects that overheating, the duty ratio DR of oscillatory output $V_a$ is low. As a result, both the time period for which gate circuit 60 generates a gate signal G and the time period for which ignition plug 32 continues to misfire are short within the oscillation period T. For each oscillation period, ignition plug 32 intermittently repeats its misfire so that the engine r.p.m. gradually decreases. That difference $(V_n-V_r)$ gradually decreases in accordance with the reduction in the engine r.p.m. so that the misfire period of ignition plug 32 is lengthened by the increase in the duty ratio DR. As a result, the engine is smoothly decelerated. That difference is expressed by $V_n-V_r=V_n$ after the time $t_1$ when the output voltage $V_r$ of delay circuit 54 is reduced to zero. If the throttle is maintained at its full open position, the duty ratio DR will be held constant so that the engine continues its revolutions at a low speed. If the temperature detector 48 is closed, buzzer 50 also generates a warning sound while light emitting diode 46 flashes in accordance with the conduction and nonconduction of thyristor 44.

In the embodiment thus far described, F/V converting circuit 42 is used so that the duty ratio DR of the oscillation circuit 58 may be changed by the velocity voltage $V_n$ from the output of F/V converter 42 to decelerate the engine remarkably smoothly. Further, the present invention can attain the desired effects if the period and the time period for the intermittent misfire are properly set. In the embodiment described, moreover, delay circuit 54 is provided to change the duty ratio DR of oscillation circuit 58 in accordance with the difference $(V_n-V_r)$ so that the engine is decelerated more smoothly. In the embodiment, still moreover, the output of the charging coil 12 is grounded, when the engine overheats, through thyristor 44, light emitting diode 46 and temperature detector 48. For example, the anode of thyristor 44 may be connected with the charging terminal of capacitor 20, as indicated in phantom line to switch 38 in FIG. 1, so that the charge on capacitor 20 may be released through thyristor 44, and so on. On the other hand, thyristor 22 may be prevented from sparking to effect the misfire by connecting the anode of thyristor 44 and the input terminal waveform shaping circuit 40 with pulser coil 14 and charging coil 12, respectively, so that the pulse signal P may also be released through thyristor 44 and resistor 45 when in the sparking operation of thyristor 44. It is also apparent that either buzzer 50 and/or light emitting diode 46 for warning of overheating may be omitted if desired. If buzzer 50 and battery 52 are omitted, more specifically, only light emitting diode 46 flashes to provide a warning when the overheating takes place. If the series circuit of resistor 49 and light emitting diode 46 is omitted, on the other hand, only buzzer 50 will operate.

As has been described hereinbefore, the present invention is constructed such that the oscillation circuit is made to oscillate in accordance with the output of the temperature detector when the engine is overheated so that a misfire is caused during a predetermined time period within the period of the oscillation circuit. As a result, during the deceleration of the engine, the misfire is intermittently effected so that the engine can be smoothly decelerated. Thus, shocks during the deceleration can be lightened.

This invention is not to be limited by the embodiment shown in the drawings and described in the description, which is given by way of example and not of limitation, but only in accordance with the scope of the appended claims.

We claim:

1. A system for decelerating an overheated internal combustion engine comprising;

temperature detecting means for detecting when said engine is overheated;

intermittent interrupting circuit means for intermittently interrupting an ignition spark of said engine when said temperature detecting means detects overheating;

said intermittent interrupting circuit means adapted gradually to increase the rate of interruptions of said ignition spark, whereby said engine is smoothly decelerated.

2. A system according to claim 1 in which said intermittent interrupting means includes oscillating means having a gradually increasing duty cycle.

3. A system according to claim 2 in which said temperature detecting means comprises a temperature sensitive switch which activates said oscillating means in response to overheating of said engine.

4. A system according to claim 3 in which said oscillating means comprises;

a velocity voltage generating means;

an integrated voltage generating means;

an oscillator receiving the outputs of said velocity voltage generating means and integrated voltage generating means; said oscillator having its output duty cycle varied according to the difference of said velocity voltage and said integrated voltage.

5. A system according to claim 3 including:

a charging coil for charging an ignition circuit of said engine;

a thyristor connected to said charging coil;

said temperature detecting switch connecting said thyristor to ground;

gate circuit means connecting the output of said oscillating means to the gate of said thyristor;

whereby the output of said charging coil is intermittently grounded through said thyristor according to the duty cycle of said oscillating means thereby interrupting the spark of said ignition circuit.

6. A system according to claim 5 including a light emitting diode between said thyristor and said temperature detector for indicating intermittent operation of said engine ignition circuit.

7. A system according to claim 3 including an audio alarm connected to said temperature detecting switch for providing an audible output when overheated condition is detected.

* * * * *